US007773362B1

(12) United States Patent
Wirz

(10) Patent No.: US 7,773,362 B1
(45) Date of Patent: Aug. 10, 2010

(54) ACCELERATOR SYSTEM AND METHOD OF ACCELERATING PARTICLES

(75) Inventor: Richard E. Wirz, Altadena, CA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 668 days.

(21) Appl. No.: 11/683,007

(22) Filed: Mar. 7, 2007

(51) Int. Cl.
*B05B 5/053* (2006.01)

(52) U.S. Cl. ..... 361/226

(58) Field of Classification Search ..... 361/226; 60/202; 315/111.21, 111.81
See application file for complete search history.

(56) References Cited

U.S. PATENT DOCUMENTS 3,387,218 A * 6/1968 Fruchtenicht et al. ..... 315/506
6,145,298 A 11/2000 Burton
6,996,972 B2 * 2/2006 Song ..... 60/202
2008/0028743 A1 * 2/2008 Wahl ..... 60/202
2008/0030920 A1 * 2/2008 Krichtafovitch et al. .... 361/233

FOREIGN PATENT DOCUMENTS

EP 0 304 840 A2 8/1988
JP 04076275 A * 3/1992

OTHER PUBLICATIONS

English Translation of previously cited (JP 04076275 A), 7 pages of text and 2 sheets of Drawings.*

* cited by examiner

*Primary Examiner*—Ronald W Leja
(74) *Attorney, Agent, or Firm*—Mark Homer

(57) ABSTRACT

An accelerator system and method that utilize dust as the primary mass flux for generating thrust are provided. The accelerator system can include an accelerator capable of operating in a self-neutralizing mode and having a discharge chamber and at least one ionizer capable of charging dust particles. The system can also include a dust particle feeder that is capable of introducing the dust particles into the accelerator. By applying a pulsed positive and negative charge voltage to the accelerator, the charged dust particles can be accelerated thereby generating thrust and neutralizing the accelerator system.

27 Claims, 9 Drawing Sheets

ACCELERATOR SYSTEM AND METHOD OF ACCELERATING PARTICLES

STATEMENT AS TO FEDERALLY-SPONSORED RESEARCH

The invention described herein was made in the performance of work under a NASA contract, and is subject to the provisions of Public Law 96-517 (U.S.C. 202) in which the Contractor has not elected to retain title.

FIELD OF THE INVENTION

The present teachings relate to an accelerator system and method that utilize dust as a primary mass flux for generating thrust. In particular, the present teachings relate to an in-space propulsion accelerator and method that feeds, ionizes, and accelerates dust particles to generate thrust in outer space.

BACKGROUND OF THE INVENTION

One of the primary challengers of space missions is the reduction of payload mass which directly concerns the weight of hauling propellants from Earth's surface to outer space. One contemplated option for the reduction of payload mass is the use of in-situ resource utilization (ISRU) to create the bulk of the propellant required for in-space thrust at an intermediate location away from Earth's surface.

Some ISRU concepts, such as the one referenced in 'Mining the Moon, the Gateway to Mars', Leonard David, Nov. 10, 2004, hope to extract oxygen from the dusty lunar soil which would require the acquisition of an additional material to serve as the propellant. Furthermore, oxygen extraction requires complex chemical processes that are difficult to conduct in outer space. Moreover, the equipment required to perform such a chemical extraction process adds mass, complexity, and risk to the space mission which can nullify advantages of implementing ISRU.

Accordingly, there is a continuing need for an accelerator system and method that does not require expensive and massive propellant extraction equipment.

SUMMARY OF THE INVENTION

The present teachings provide an accelerator system and method that can implement the use of readily available dust particles to generate thrust.

According to the present teachings, the accelerator system includes an accelerator that includes an ionizer capable of charging dust particles within a discharge chamber of the accelerator. Moreover, the accelerator is capable of operating in a self-neutralizing mode by alternating positive and negative charged voltage applied to the accelerator. The accelerator system of the present teachings also includes a dust particle feeder capable of introducing dust particles into the accelerator.

According to another embodiment of the present teachings, an accelerator system includes an accelerator including a discharge chamber and at least one of a photon source and a high-energy electron emitting source in communication with the discharge chamber. The accelerator system also includes a dust particle feeder arranged to introduce dust particles into the discharge chamber of the accelerator. Each of the photon source and the high-energy electron emitting source are capable of positively charging the dust particles.

The present teachings also describe a method of accelerating dust particles. The method includes feeding dust particles into an accelerator by way of a dust feeder, charging the dust particles with a positive or a negative charge within the accelerator, and applying a first electric potential to the accelerator to accelerate the charged dust particles. For self-neutralizing operation, the method includes applying a second electric potential, different from the first electric potential, to the accelerator.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

The present teachings are directed to an accelerator system and method to feed, ionize, and accelerate charged particles, such as dust, in order to generator thrust. An embodiment of the accelerator system includes an accelerator that is capable of operating in a self-neutralizing mode. The charged particles can be accelerated out of a discharge chamber of an accelerator system by way of the application of electrostatic or electromagnetic forces to the accelerator thereby generating thrust.

Figure 1:
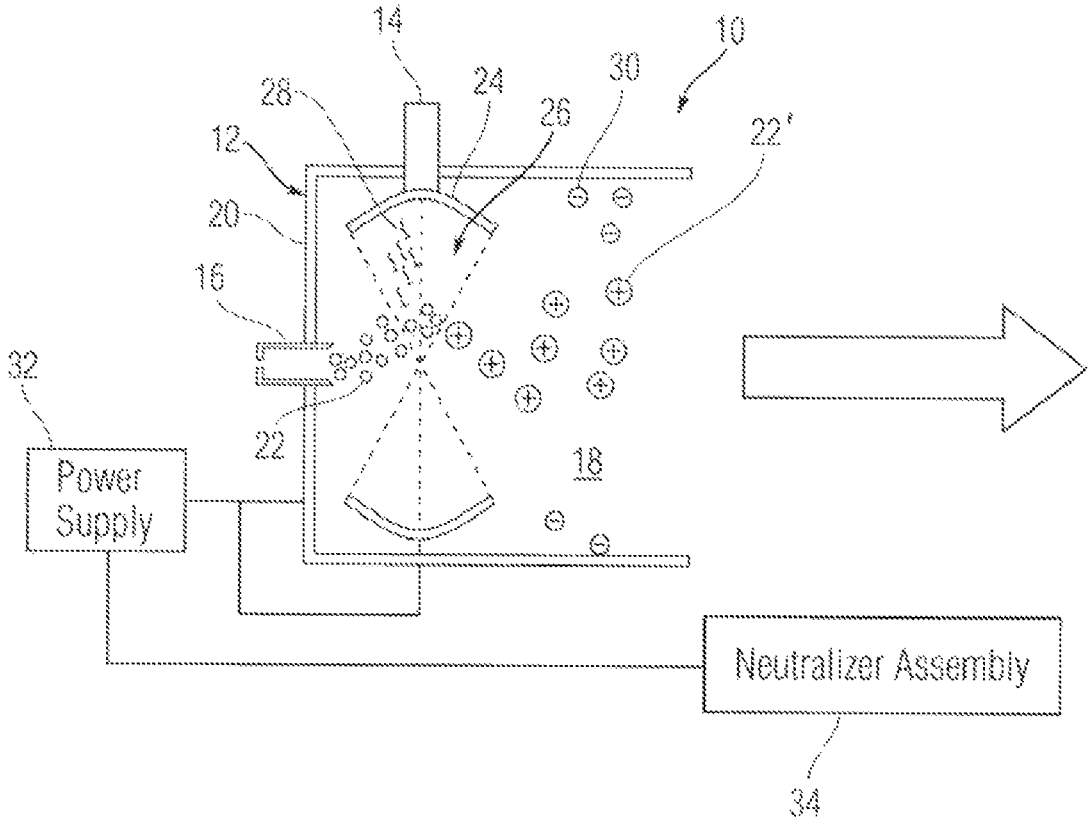
FIG. 1 is a side view of an accelerator system according to various embodiments.

Referring to FIG. 1, an embodiment of the accelerator system 10 of the present teachings is shown. The accelerator system 10 can include a dust feeder 16, an accelerator 12, and a photon source 14. The accelerator 12 forms a discharge chamber 18, which can be defined by a plurality of walls 20. Preferably, the walls 20 are made from an electrically conductive material. The dust feeder 16 can be arranged to introduce particles 22, such as dust particles, into the discharge chamber 18 of the accelerator 12.

The particles used with the system and method of the present teachings can have an size and can possess any chemical composition as long as the particles are capable of gaining a positive or negative charge. For example, the particles can be dust composed of $SiO_2$, $Al_2O_3$, or various other compositions, such as those present in lunar soil. Such dust particles can be found on earth or in outer space depending upon the desired environment of use of the accelerator system.

In one exemplary embodiment, the accelerator system 10 can include one or more photon lenses 24 which can be used to volume photo-ionize the dust particles 22. The dust particles 22 can be photo-ionized at various times and/or locations, for example, after they have been introduced into the accelerator 12 by way of the dust feeder 16 or just prior to being introduced into the accelerator 12. As shown in FIG. 1, the photon lens 24 can be located within the discharge chamber 18 and arranged on or in the vicinity of a respective photon source 14 such that photons can be directed through the photon lens 24 and into the photo-ionization envelope 26 upon emission from the photon source 14. Alternatively, the photo lens 24 may be located outside of the discharge chamber 18 if transparent discharge materials are used. Preferably, the photon lens 24 can be a conical lens that can be formed to be symmetrical about an axis of the accelerator 12. During operation, the photon lens 24 operates to at least partially confine photons 28 emitted from the photon source 14 within the photo-ionization envelope 26. Moreover, the photon source 14 can be any photon source, such as an ultra-violet source.

The dust feeder 16 can operate to introduce dust particles 22 into the photo-ionization envelope 26. Within the photo-ionization envelope 26, the photons 28 cause electrons 30 to be liberated from the dust particles 22, thereby creating positively charged dust particles 22'. The photon lens 24 operates to increase the probability that the photons 28 intersect with the introduced dust particles 22 before the photons 28 dissipate front the accelerator 12.

The dust feeder 16 of the accelerator system 10 can introduce dust particles into the accelerator 12 by any known method. For example, the dust particles can be introduced by way of active injection or by passive injection. Active injection of the dust particles can be accomplished by any known mechanical introducing method, such as by a blower. Passive injection can be accomplished by forming a charge on the dust particles while they are resident within a reservoir source and then expelling them from the reservoir source by mutual or induced repulsion.

To accelerate the positively charged dust particles 22' or the liberated electrons 30 within the discharge chamber 18, an accelerator power supply 32 can be arranged to apply electric potentials to the walls 20 of the accelerator 12. By changing the applied voltage (e.g., applying alternating positive and negative potentials) to the walls 20, the liberated electrons 30 and/or the positively charged that particles 22' can be accelerated out of the discharge chamber 18. The application of such temporal voltages is shown graphically in FIGS. 2 and 3. Optionally, the power supply 32 can also apply a potential to the photon lens 24 if the photon lens 24 is formed from electrically conductive material and is arranged in an exposed condition within the discharge chamber 18.

Figure 2:
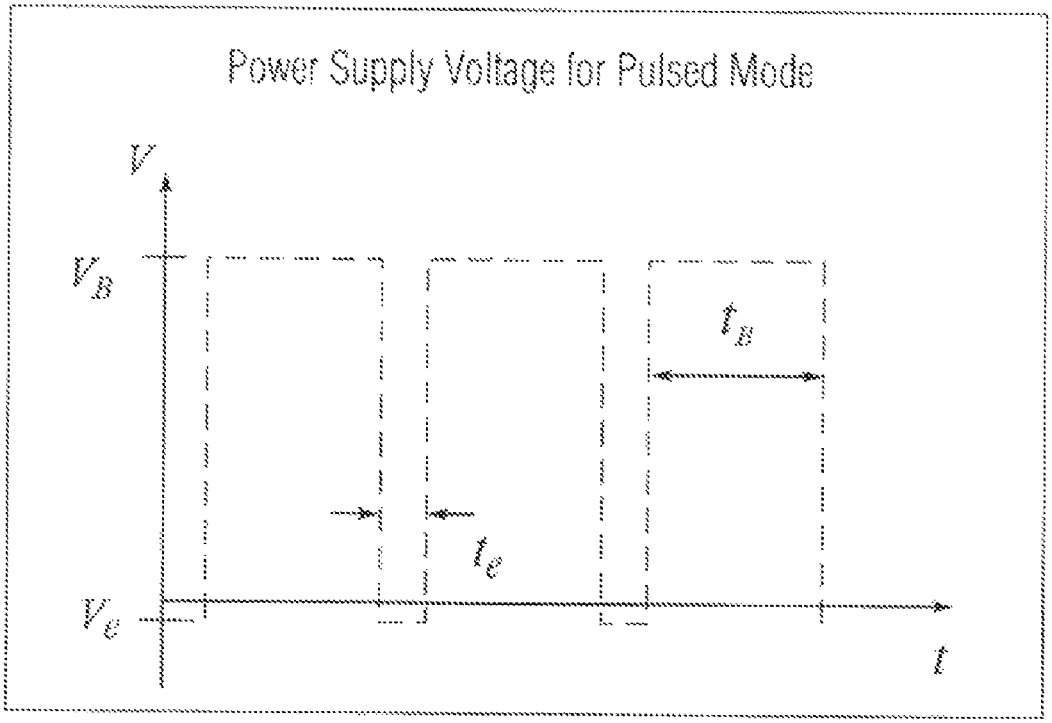
FIG. 2 is a graph showing a pulsed mode of supplying voltage for the accelerator system shown in FIG. 1.

Referring to FIG. 2, a power supply voltage for pulsed mode operation of the accelerator 12 is shown. In this exemplary embodiment, the accelerator power supply 32 provides a positive charge voltage $V_B$ for a time $t_B$ to the walls 20 of the accelerator 12 to accelerate the positively charged dust particles 22' out of the discharge chamber 18. As the process continues however, electrons 30 can accumulate in the accelerator 12 thereby negatively charging the accelerator system 10.

To prevent the accelerator system 10 from gaining an excessively large negative charge, the pulsed mode operation of the accelerator power supply 32 periodically provides a negative voltage $V_c$ for a time period $t_c$ to the walls 20 of the accelerator 12 to repel electrons 30 in the accelerator 12. By operating the accelerator power supply 32 in the pulsed mode, the accelerator system 10 can self-neutralize. In some conditions, as shown in FIG. 1, a neutralizer assembly 34 is necessary to achieve neutralization.

Figure 3:
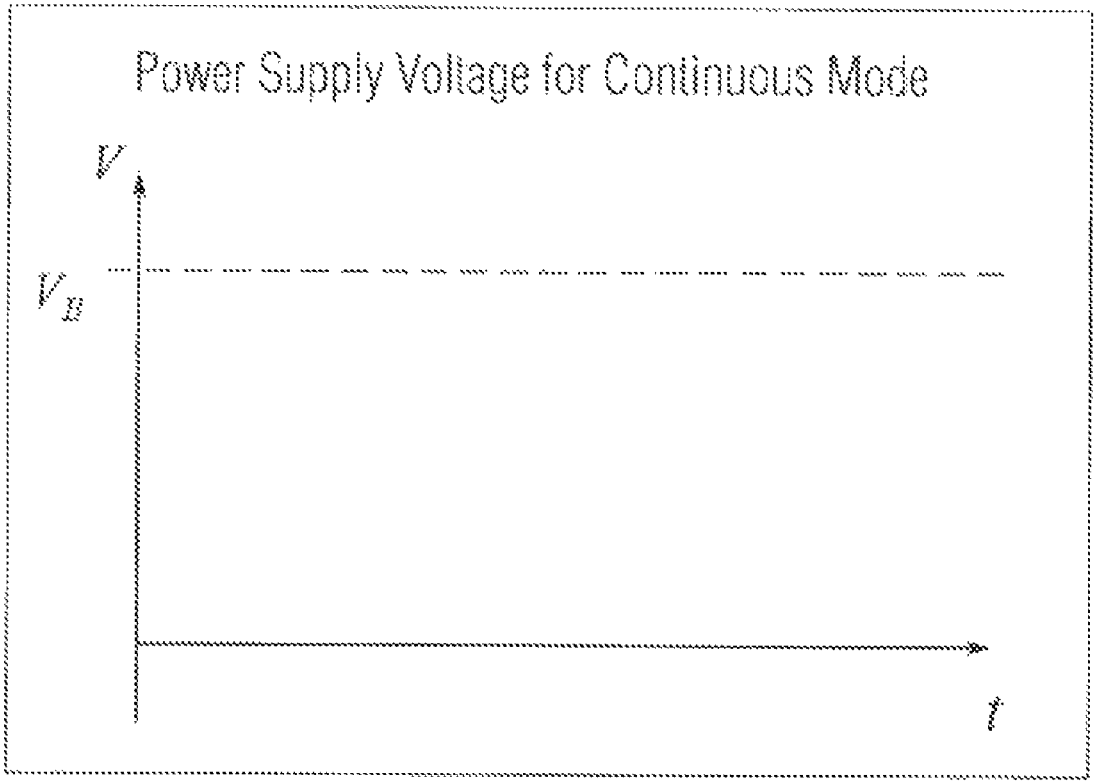
FIG. 3 is a graph showing a continuous mode of supplying voltage for the accelerator system shown in FIG. 1.

As represented in FIG. 2, given that electrons have a higher charge-to-mass ratio in relation to positive ions, during pulsed mode operation the positive voltage $V_B$ applied to the walls 20 of the accelerator 12 can be higher and can be applied for a longer duration compared to the negative voltage $V_c$ applied to the walls 20, compare $t_B$ with $t_c$, FIG. 3 shows a power supply voltage for continuous mode operation of the accelerator system 10 of the present teachings. In this embodiment, the accelerator power supply 32 can be operated in a continuous mode whereby a continuous positive charge voltage $V_B$ is applied to the walls 20 of the accelerator 12 (and optionally to the photon lens 24) to accelerate the positively charged dust particles 22' within the discharge chamber 18. In contrast to pulsed mode operation, the accelerator power supply 32 does not provide a negative charge voltage to the walls 20 to repel accumulated electrons 30. As a result, the accelerator system 10 can gain an excessive negative charge. As shown in FIG. 1, a neutralizer assembly 34 can be implemented to prevent the accelerator system 10 from gaining such an excessive negative charge.

According to various embodiments, a high-energy electron emitting source can be implemented in place of the photon source 14 in the accelerator system 10 of FIG. 1. The photon lens 24 will then effectively function as an electron lens to confine the electrons emitted from the high-energy electron emitting source. Alternatively, when the high-energy electron emitting source is implemented in place of the photon source 14, a magnetic field generator capable of forming a magnetic field can confine the electrons emitted from the high-energy electron emitting source. With respect to the neutralization of the accelerator system 10, either a neutralization source (e.g., a neutralizer assembly 34) or performing an inverted voltage profile (as represented in FIG. 2) would be necessary to prevent the positively-charged particle emitting accelerator system 10 from gaining an excessive negative charge. Furthermore, the accelerator system 10 can include an optional grid structure at the exit of the discharge chamber 18. The grid structure can include one of an ion optic grid and a magnetic grid.

Neutralization of the present teachings as shown in FIGS. 1-3 and all other embodiments described below can also be achieved by using positive and negative sources side-by-side. For example, a positive source and a negative source can be used in tandem to achieve over-charge neutralization, which is known as a "bi-polar" configuration. In one example, the positive and negative sources can be a high-energy electron emitting source and a low-energy electron emitting source respectively.

Figure 4:
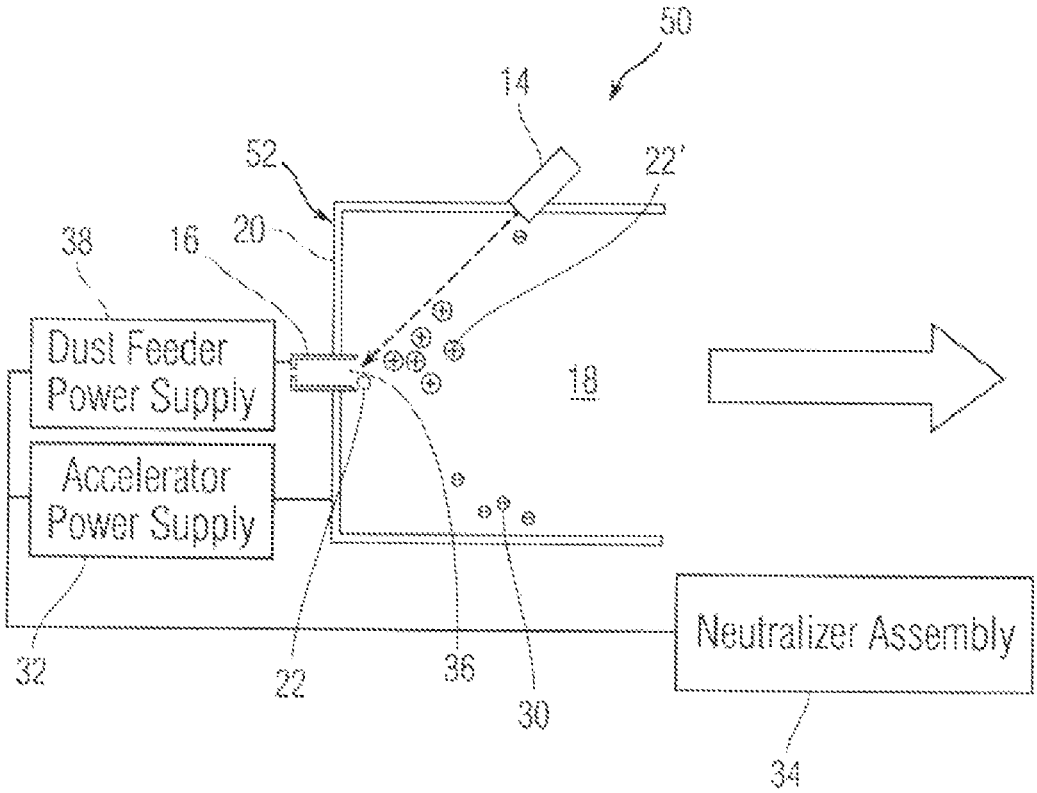
FIG. 4 is a side view of an another accelerator system according to various embodiments.

FIG. 4 shows another embodiment of an accelerator system 50 of the present teachings. The accelerator system 50 can include an accelerator 52 having a photon source 14 that is aimed or directed towards an exit 36 of the dust feeder 16. The accelerator system 50 of FIG. 4 operates in a manner similar to the accelerator system 10 shown in FIG. 1. However, in the accelerator system 50, the charging of dust particles 22 occurs primarily in the vicinity of the dust feeder exit 36. Moreover, this accelerator system 50 can include an optional dust feeder power supply 38 as well as a separate accelerator power supply 32.

The dust feeder power supply 38 can operate to liberate the dust particles 22 and to accelerate charged dust particles 22' out and away from the exit of the dust feeder 16. As discussed above with respect to the embodiment of FIG. 1, the accelerator power supply 32 can charge the walls 20 of the accelerator 52 with a voltage. In both the pulsed mode (graphically shown in FIG. 5) and in the continuous mode (graphically shown in FIG. 6), the dust feeder power supply 38 can be used to promote both the injection of the dust particles 22 into the discharge chamber 18 and to accelerate the positively charged dust particles 22' out of the discharge chamber 18 thereby generating thrust. Accordingly, it is preferable that the dust feeder 16 is made from an electrically conductive material when it is electrically charged to facilitate dust injection.

Figure 5:
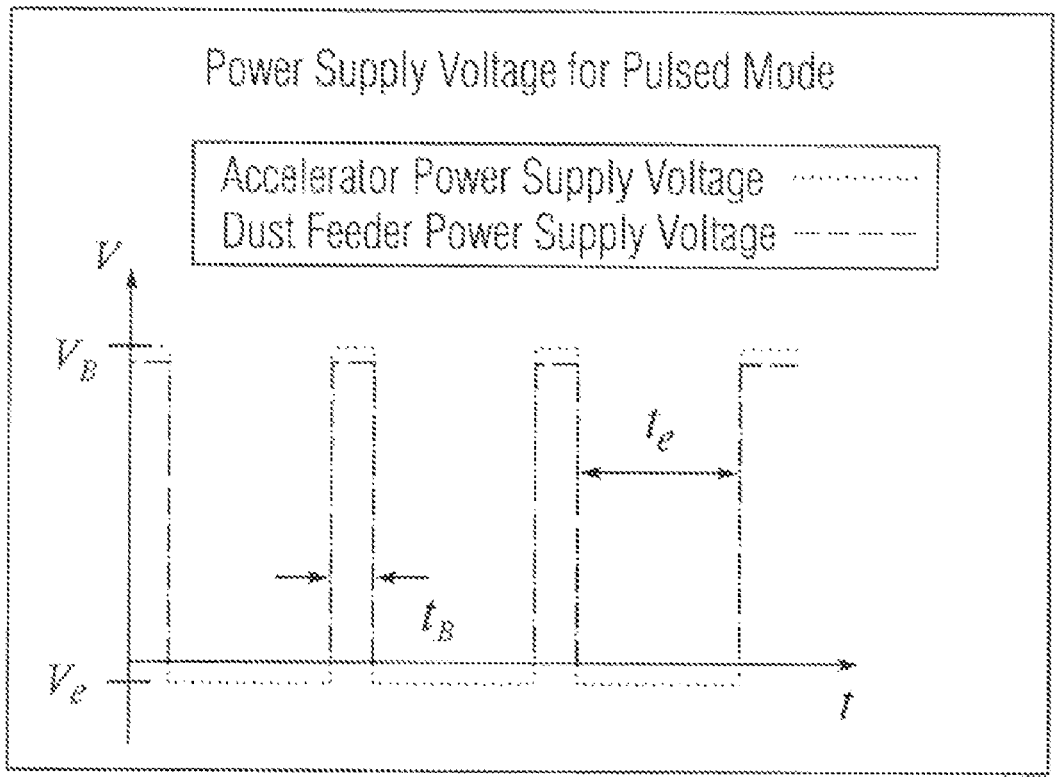
FIG. 5 is a graph showing a pulsed mode of supplying voltage for the accelerator system shown in FIG. 4.

With more specific reference to the pulsed mode operation shown in FIG. 5, initially the dust feeder power supply 38 can provide a positive charge voltage for a time $t_B$ to the dust feeder 16. Simultaneously, the accelerator power supply 32 can provide a positive charge voltage $V_B$ for the same period of time $t_a$ to the walls 20 of the accelerator 52. Preferably, the positive charge voltage $V_B$ provided by the accelerator power supply 32 is slightly higher than the positive charge voltage provided by the dust feeder power supply 38. This voltage difference can help focus positive ions out of the accelerator 52 and prevent direct impingement of the positive ions on the walls 20 of the accelerator 52. Additionally, this voltage difference can promote electrons liberated during this process to be preferentially collected on the walls 20 and not on the dust feeder 16.

Furthermore, the injection of the dust particles 22 into the discharge chamber 18 and the acceleration of the positively charged dust particles 22' out of the accelerator 52 can be pulsed for a predetermined time $t_c$. This can be achieved by reducing the voltage of the dust feeder power supply 38 and the voltage of the accelerator power supply 32, as shown in FIG. 5. For example, the voltage of the dust feeder power supply 38 can be reduced to a modest voltage or zero voltage (i.e., the dust feeder 16 is grounded) while the voltage of the accelerator power supply 32 can be reduced to provide a negative charge voltage $V_c$ to the walls 20. Subjecting the walls 20 of the accelerator 52 to a negative charge voltage accelerates the electrons 30 during the pulsed phase. Preferably, the positive charge voltage applied to the walls 20 to accelerate the positively charged dust particles 22' is higher than the applied negative charge voltage in order to accelerate or repel the electrons 30 due to the relatively larger inertia and small charge-to-mass ratio of the positively charged dust particles 22'. Accordingly, in the pulsed mode the accelerator system 50 can be self-neutralizing.

Figure 6:
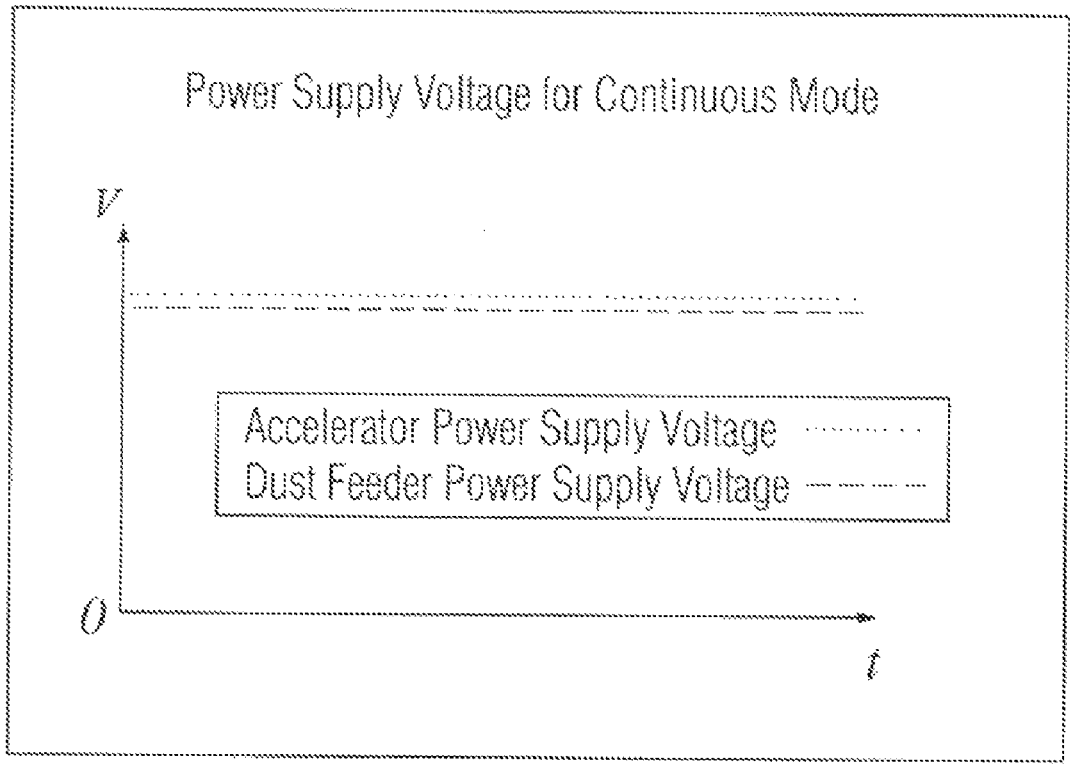
FIG. 6 is a graph showing a continuous mode of supplying voltage for the accelerator system shown in FIG. 4.

With more specific reference to the continuous mode operation shown in FIG. 6, the accelerator power supply 32 and the dust feeder power supply 38 provide a positive charge voltage to the walls 20 and to the feeder 16, respectively. The positive charge provided to the walls 20 can be greater, equal, or less than the positive charge voltage provided to the dust feeder 16. Preferably, the accelerator power supply 32 provides the walls 20 with a slightly higher positive charge voltage than the positive charge voltage that is provided to the dust feeder 16. As in pulsed mode operation, the positive charge applied to the dust feeder 16 can promote both the injection of the dust particles 22 into the discharge chamber 18 and the acceleration of the positively charged dust particles 22' out of the accelerator 52 in order to generate thrust. Furthermore, the higher positive charge voltage provided to the walls 20 can focus the positive ions out at an even greater velocity. To prevent the spacecraft from gaining excessive charge, a neutralizer assembly 34 can be implemented into the accelerator system 50.

According to various embodiments, the photon source 14 of the accelerator system 50 of FIG. 4 can be replaced by a high-energy electron emitting source, which can, under the correct voltages, provide positive ionization of the dust particles 22. With respect to the neutralization of the accelerator system 50, either a neutralization source (e.g., neutralizer assembly 34) or performing an inverted voltage profile (as represented in FIG. 5) could be provided to prevent the accelerator system 50 from gaining an excessive negative charge. Furthermore, the accelerator system 50 can include an optional grid structure at the exit of the discharge chamber 18. The grid structure can include ion optic grids or a magnetic grid.

Figure 7:
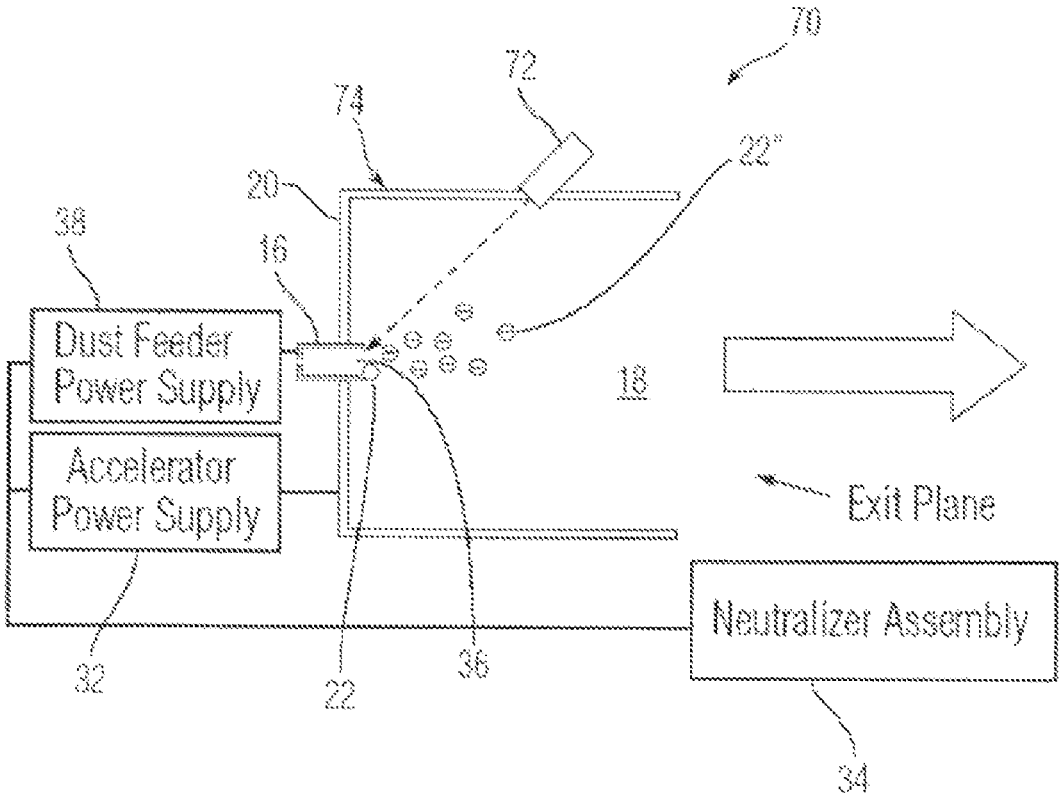
FIG. 7 is a side view of yet another accelerator system according to various embodiments.

As previously discussed above, the dust particles 22 can also be provided with a negative charge during operation of the accelerator system. FIG. 7 shows an embodiment of an accelerator system 70 of the present teachings which is capable of accelerating negatively charged dust particles 22" to generate thrust. The accelerator system 70 includes an electron source 72 (e.g., a low-energy electron source), an accelerator 74, and a dust feeder 16. The electron source 72 can perform localized ionization near the exit of the dust feeder in order to negatively charge the dust particles 22 within the walls 20 of the accelerator 74. Preferably, the localized ionization of the dust particles 22 occurs near the exit of the dust feeder 16. Furthermore, the accelerator system 70 can optionally include a dust feeder power supply 38 and a separate accelerator power supply 32 as will be more fully discussed below.

Figure 8:
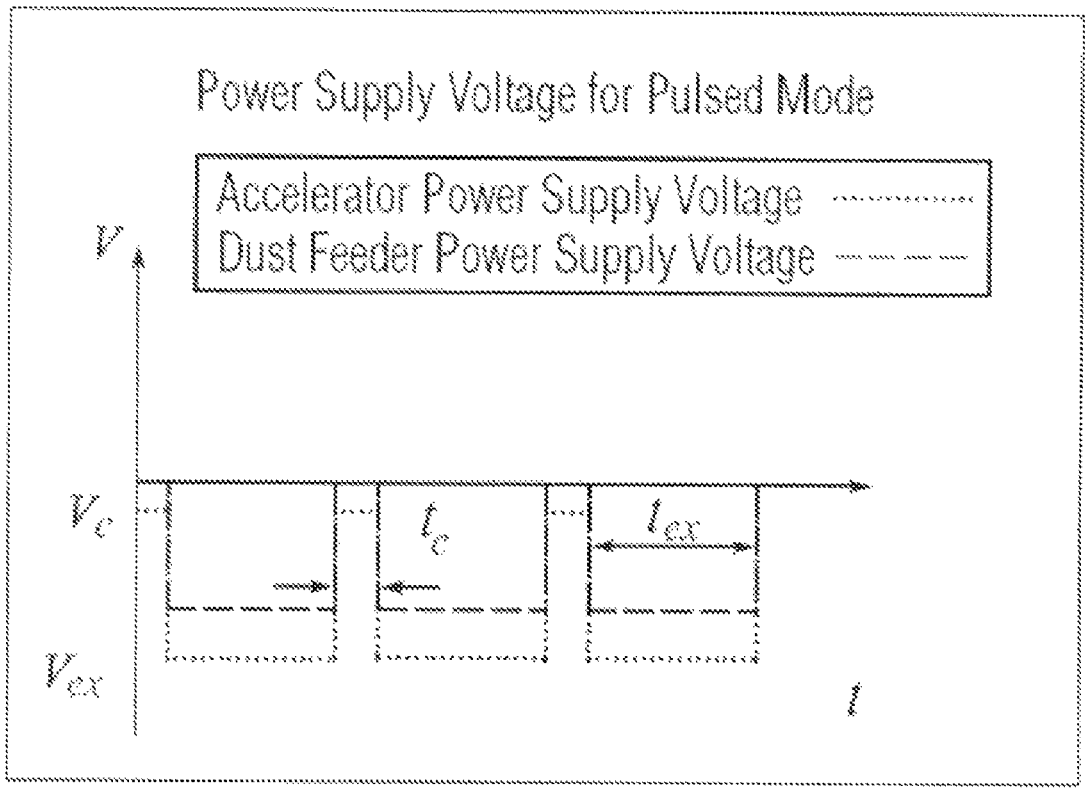
FIG. 8 is a graph showing a pulsed mode of supplying voltage for the accelerator system shown in FIG. 7.

Referring to FIGS. 7 and 8, during initial operation of the accelerator system 70, the accelerator power supply 32 can provide a negative charge voltage $V_e$ for a period of time $t_e$ to the walls 20 of the accelerator 74. during the time $t_e$, the electron source 72 can be electrically connected to the walls 20 such that the voltage of the electron source 72 is substantially similar to the voltage of the walls 20. This configuration can encourage the electrons to impinge the dust feeder 16 and to negatively charge the dust particles 22". To urge the dust particles 22" to gain a large negative charge, the electron source 72 can bombard the dust particles 22" with electrons at the dust feeder exit 36. As shown in FIG. 7, the orientation of the electron source 72 with respect to the dust feeder 16 can allow the electron source 73 to directly bombard the dust particles 22". Preferably, the energy of the electrons in the electron source 72 is kept sufficiently low to facilitate the collection of the electrons by the dust particles 22".

Additionally, when the accelerator power supply 32 provides the negative charge voltage $V_e$ to the walls 20, the dust feeder power supply 38 provides a low/modest voltage (e.g., a voltage that is substantially zero) or a zero voltage (i.e., the dust feeder is grounded). To accelerate the negatively charged dust particles 22", the accelerator power supply 32 and the dust feeder power supply 38 can provide negative charges to the walls 20 and to the dust feeder 16, respectively, for a time $t_{ex}$. The negative charge voltage $V_{ex}$ provided to the walls 20 can be greater, equal, or less than the negative charge voltage provided to the dust feeder 16. Preferably, the negative charge voltage $V_{ex}$ provided to the walls 20 is at least slightly higher than the negative charge voltage provided to the dust feeder 16 to focus the particles.

As shown in FIG. 7, the accelerator system 70 mainly accelerates electrons and/or negatively charged dust particles 22". Therefore, in order to prevent the accelerator system 70 from gaining an excessive positive charge, a neutralizer assembly 34 that expels positive charges, such as a positive dust or ion source, can be implemented.

According to various embodiments, the accelerator system 70 can also be provided with any sources that can operate to positively charge the dust particles 22. For example, the accelerator system 70 can include both an electron source 72 and a photon source, such as one described above with respect to FIG. 4. Alternatively, the accelerator system 70 can include both a high-energy electron emitting source and a low-energy electron emitting source, to positively and negatively charge the dust particles 22, respectively. Additionally or alternatively, the accelerator power supply 32 can provide a positive charge to the walls 20 to accelerate any accumulated positively charged particles or cations out of the accelerator systems 70 to neutralize the system 70.

Figure 9:
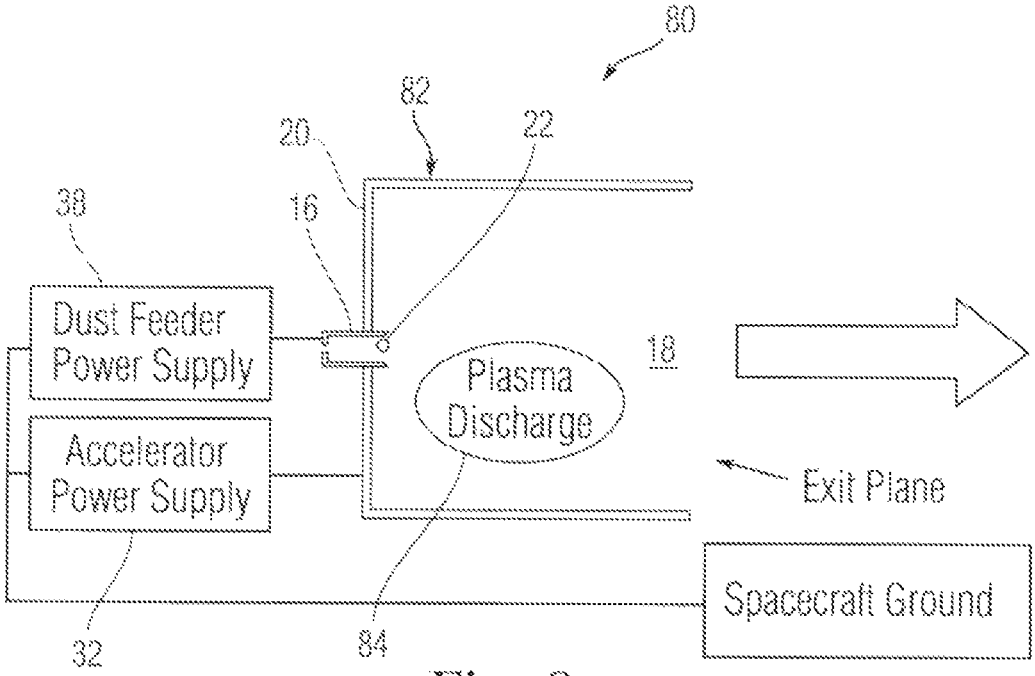
FIG. 9 is a side view of yet another embodiment of the accelerator system according to various embodiments.

FIG. 9 shows yet another embodiment of an accelerator system 80 of the present teachings. The accelerator system 80 can be a self-neutralizing system that can utilize a plasma discharge 84 arranged in the discharged chamber 18 as an electron source to negatively charge dust particles 22 to generate thrust. The plasma discharge for the accelerator system 80 can be provided by way of any plasma source (not specifically shown in FIG. 9), such as a dc discharge source, an rf discharge source, and/or a microwave discharge source. Furthermore, the accelerator system 80 can include an accelerator 82 that can operate similarly to known ion thrusters for much of its operation. However, the dust particles 22 tend to obtain a negative charge instead of a positive charge when they come into contact with the plasma 84, the dust particles being negatively charged at the outlet of the dust feeder 16 and/or throughout the volume of the discharge chamber 18. Optionally, a dust feeder power supply 38 can be utilized to further accelerate the charged dust particles 22 and/or to facilitate the injection of the dust particles 22 into the discharge chamber 18 for further charging. Furthermore, the accelerator system 80 can include an optional grid structure at the exit of the discharge chamber 18 to assist in the maintenance of the plasma. The grid structure can include one of an ion optic grid and a magnetic grid.

Figure 10:
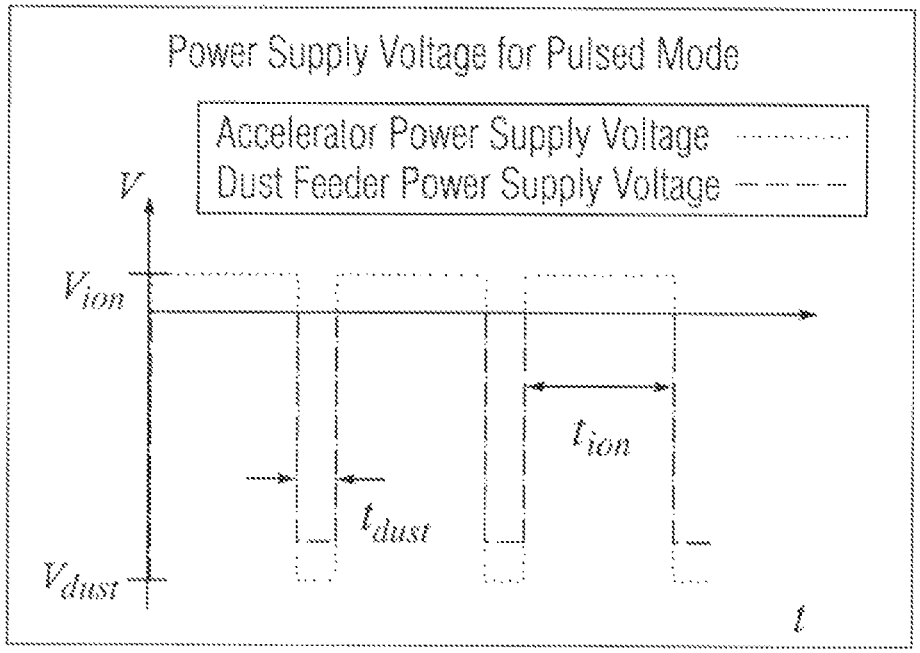
FIG. 10 is a graph showing a pulsed mode of supplying voltage for the accelerator system shown in FIG. 9.

Referring to FIG. 10, an example power supply voltage profile for pulsed mode operation of the accelerator 82 is shown. During operation, to accelerate the negatively charged dust particles within the discharge chamber 18, the optional dust feeder power supply 38 can provide a negative voltage charge to the dust feeder 16 for a predetermined time $t_{dust}$. Simultaneously, the accelerator power supply 32 can provide a negative charge voltage $V_{dust}$ to the walls 20 for the time $t_{dust}$ in order to focus and accelerate the negative charged dust particles. The negative charge voltage $V_{dust}$ provided to the walls 20 can be greater, equal, or less than the negative charge voltage provided to the dust feeder 16. Preferably, the negative charge voltage $V_{dust}$ applied to the walls 20 is at least slightly higher than the negative charge voltage provided to the dust feeder 16 by the dust feeder power supply 38.

The accelerator system 80 acts much like a conventional ion thruster by expelling positive ions from the accelerator 28. However, during the time $t_{ion}$ the dust feeder 16 can be grounded or have a low/modest voltage (e.g., a voltage that is substantially zero) to allow the dust 22 to attain a negative charge from the plasma discharge. Simultaneously, during the time $t_{ion}$ the accelerator power supply 32 can provide a positive charge voltage $V_{ion}$ to the walls 20 in order to accelerate the accumulated positively charged particles. This cycling of the voltage, as shown in FIG. 10, can be repeated as many times as necessary to generate the necessary thrust and to prevent the accelerator system 80 from gaining an excessive charge.

According to various embodiments, the accelerator system of the present teachings can be configured as a Hall thruster that utilizes dust particles as the primary mass flux to generate thrust. For example, such a Hall thrust can be configured to operate as a reverse Hall thruster to take advantage of the tendency of the dust particles to attain a negative charge. In another embodiment, the Hall thruster can be configured to utilize an oscillating voltage to accelerate both negative and positive charged components in its respective discharge chamber.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. An accelerator system comprising:

an accelerator including an ionizer capable of charging dust particles within a discharge chamber of the accelerator, the accelerator being capable of operating in a self-neutralizing mode by applying a voltage change thereto: and a dust particle feeder capable of introducing dust particles into the accelerator such that application of voltage change promotes at least one of dust particle injection, dust particle acceleration, and accelerator system neutralization.

2. The accelerator system of claim 1, wherein the ionizer includes at least one of a photon source, a high-energy electron emitting source, a low-energy electron source, and a plasma source.

3. The accelerator system of claim 2, wherein when the ionizer is a photon source, the accelerator further includes a photon lens arranged to confine photons emitted from the photon source.

4. The accelerator system of claim 2, wherein when the ionizer is a high-energy electron emitting source, the accelerator further includes an electron lens arranged to confine electrons emitted from the high-energy electron emitting source.

5. The accelerator system of claim 2, wherein when the ionizer is at least one of high-energy and low-energy electron emitting source, the accelerator further includes a magnetic field generator capable of forming a magnetic field to confine electrons emitted from the at least one of high-energy and low-energy electron emitting source.

6. The accelerator system of claim 2, wherein the ionizer includes a low-energy electron source and a photon source, each capable of being alternately activated such that when the low-energy electron source is activated, the accelerator is capable of expelling negatively-charged particles and when the photon source is activated, the accelerator is capable of expelling positively-charged particles.

7. The accelerator system of claim 2, wherein the ionizer includes a low-energy electron source and a high-energy electron source, each capable of being alternately activated such that when the low-energy electron source is activated, the accelerator is capable of expelling negatively-charged particles and when the high-energy electron source is activated, the accelerator is capable of expelling positively-charged particles.

8. The accelerator system of claim 1, wherein the dust particle feeder is capable of introducing the dust particles into the discharge chamber by one of active injection and passive injection.

9. The accelerator system of claim 8, further comprising a reservoir in communication with the discharge chamber, wherein passive injection includes charging the dust particles in the reservoir and introducing the charged dust particles into the discharge chamber by mutual or induced repulsion.

10. An accelerator system comprising:

an accelerator including a discharge chamber and at least one of a photon source and a high-energy electron emitting source the communication with the discharge chamber; and a dust particle feeder arranged to introduce dust particles into the discharge chamber of the accelerator;

wherein each of the photon source and the high-energy electron emitting source are capable of positively charging the dust particles.

11. The accelerator system of claim 10, wherein when the accelerator includes a photon source, the accelerator further includes a photon lens arranged to confine photons emitted from the photon source.

12. The accelerator system of claim 10, wherein when the accelerator includes a high-energy electron emitting source, the accelerator further includes an electron lens arranged to confine electrons emitted from the high-energy electron emitting source.

13. The accelerator system of claim 10, wherein when the accelerator includes a high-energy electron emitting source, the accelerator further includes a magnetic field generator capable of forming a magnetic field to confine electrons emitted from the high-energy electron emitting source.

14. The accelerator system of claim 10, wherein the dust particle feeder is capable of introducing the dust particles into the discharge chamber by at least one of active injection and passive injection.

15. The accelerator system of claim 14, further comprising a reservoir in communication with the discharge chamber, wherein passive injection includes charging the dust particles in the reservoir and introducing the charged dust particles into the discharge chamber to mutual or induced repulsion.

16. A method of accelerating dust particles comprising:

feeding dust particles into an accelerator by way of a dust feeder;

charging the dust particles with one of a positive and a negative charge within the accelerator;

applying a first electric potential to the accelerator to accelerate the charged dust particles; and applying a second electric potential different from the first electric potential to the accelerator to neutralize the accelerator.

17. The method of claim 16, wherein feeding dust particles into an accelerator comprises at least one of active injection and passive injection.

18. The method of claim 17, wherein passive injection comprises charging the dust particles and then introducing the charged dust particles into the accelerator by at least one of mutual and induced repulsion.

19. The method of claim 16, wherein charging the dust particles includes contacting the dust particles with at least one of photons and high-energy electrons to gain a positive charge.

20. The method of claim 16, wherein charging the dust particles includes contacting the dust particles with at least one of low-energy electrons and plasma to gain a negative charge.

21. The method of claim 16, wherein when the dust particles are positively charged, the first electric potential is a positive charge voltage applied for a first predetermined time and the second electric potential is a negative charge voltage applied for a second predetermined time.

22. The method of claim 16, further comprising at least one of grounding and applying a low voltage to the dust feeder for a first predetermined time, and wherein feeding the dust particles into the accelerator includes applying a positive charge voltage to the dust feeder for a second predetermined time to at least one of actively inject and accelerate the dust particles, and wherein the first electric potential applied to the accelerator is a positive charge voltage applied for the second predetermined time, and wherein the second electric potential applied to the accelerator is a negative charge voltage applied for the first predetermined time.

23. The method of claim 22, wherein the positive charge voltage applied to the accelerator is greater, equal to, or less than the positive charge voltage applied to the dust feeder during the second predetermined time.

24. The method of claim 16, further comprising at least one of grounding and applying a low voltage to the dust feeder for a first predetermined time and applying a negative charge voltage to the dust feeder for a second predetermined time to at least one of actively inject and accelerate the dust particles, and wherein the first electric potential applied to the accelerator is a negative charge voltage applied for the second predetermined time, and wherein the second electric potential applied to the accelerator is a negative charge voltage applied for the first predetermined time, wherein the negative charge voltage of the second electric potential is less than the negative charge voltage of the first electric potential.

25. The method of claim 24, further comprising neutralizing the accelerator by a neutralizer assembly.

26. The method of claim 16, further comprising at least one of grounding and applying a low voltage to the dust feeder for a first predetermined time and applying a negative charge voltage to the dust feeder for a second predetermined time to at least one of actively inject and accelerate the dust particles, and wherein the first electric potential applied to the accelerator is a negative charge voltage applied for the second predetermined time, and wherein the second electric potential is a positive charge voltage applied for the first predetermined time.

27. The method of claim 26, wherein charging the dust particles with the negative charge comprises introducing the dust particles to at least one of plasma and low-energy electrons.

* * * * *